US007202433B2

(12) United States Patent
Howie

(10) Patent No.: US 7,202,433 B2
(45) Date of Patent: Apr. 10, 2007

(54) APPLIANCE SELECTOR SWITCH PROGRAMMED BY CONSOLE CUTOUT

(75) Inventor: David Malcolm Howie, Foxborough, MA (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 11/041,543

(22) Filed: Jan. 24, 2005

(65) Prior Publication Data

US 2005/0167255 A1 Aug. 4, 2005

Related U.S. Application Data

(60) Provisional application No. 60/540,471, filed on Jan. 30, 2004.

(51) Int. Cl.
*H01H 19/04* (2006.01)

(52) U.S. Cl. ..... 200/565; 200/296; 200/336

(58) Field of Classification Search ..... 200/564–567, 200/293, 296, 336; 174/52.1; 248/27.1, 248/27.3

See application file for complete search history.

(56) References Cited

U.S. PATENT DOCUMENTS

| | | | | |
|---|---|---|---|---|
| 2,522,172 | A * | 9/1950 | Gates | 200/296 |
| 3,176,107 | A * | 3/1965 | Temple | 200/336 |
| 3,767,880 | A * | 10/1973 | Austin | 200/318 |
| 4,737,608 | A | 4/1988 | Jones | |
| 5,256,841 | A * | 10/1993 | Zanella | 200/296 |
| 5,631,454 | A * | 5/1997 | Hubacher et al. | 200/50.01 |
| 5,954,192 | A * | 9/1999 | Iitsuka | 200/336 |
| 6,143,999 | A * | 11/2000 | Uleski et al. | 200/296 |
| 6,281,453 | B1 | 8/2001 | Uleski | |
| 6,610,947 | B2 * | 8/2003 | Campana et al. | 200/336 |
| 6,706,982 | B1 * | 3/2004 | Knopp | 200/296 |

* cited by examiner

*Primary Examiner*—Michael A. Friedhofer
(74) *Attorney, Agent, or Firm*—Boyle Fredrickson Newholm Stein & Gratz S.C.

(57) ABSTRACT

A console switch assembly for appliances provides a rotatable electronic switch having a rotational range constrained by a cutout in the control panel to which the switch is mounted. The cutout most simply may be a sector of a circle having a different angular range which constrains a projecting tooth on the shaft of the switch or knob attached to the shaft of the switch.

16 Claims, 2 Drawing Sheets

APPLIANCE SELECTOR SWITCH PROGRAMMED BY CONSOLE CUTOUT

CROSS-REFERENCE TO RELATED APPLICATIONS

This application is based on provisional application 60/540,471 filed Jan. 30, 2004 and entitled Method for Setting Switch Travel During Final Assembly into Product and claims the benefit thereof.

STATEMENT REGARDING FEDERALLY SPONSORED RESEARCH OR DEVELOPMENT

BACKGROUND OF THE INVENTION

The present invention relates to selector switches for appliances such as washing machines, and in particular to a selector switch having the number of selector positions determined by a cutout in the panel to which it is mounted.

Appliance manufacturers often want to offer different models of a given appliance for different market segments. For example, a manufacturer may offer a high-end washing machine with eight different water level settings, a mid-range washing machine with six different water level settings, and a low-end washing machine with three different water level settings.

Each water level setting may be selected by moving a selector switch to a different position. In this case, the three models described above would require three different switches, an eight-position, a six-position and a three-position switch. Designing, manufacturing and stocking three different switches significantly increases the cost of manufacture of the machines.

It is generally known to produce rotary switches having removable internal stops that can control the range of rotation of the switch and thus the number of switch positions. While this reduces the number of switches that must be manufactured, such switches require a separate reconfiguration step, and as a practical matter, must be preconfigured and then separately stocked so as to be ready for installation and yet not to be placed into the wrong appliance.

Ideally, a method could be found for providing multiple switches for multiple models of an appliance without increasing manufacturing complexity or requiring stocking of separate configurations or time consuming additional manufacturing steps.

BRIEF SUMMARY OF THE INVENTION

The present invention provides a rotary selector switch whose rotational range is programmable, not by internal stops, but by a cutout in the console of the appliance to which the switch is mounted. The cutout is intrinsic to the appliance itself, eliminates the possibility of a misconfigured switch being inserted into an appliance. The switches need not be preconfigured and no additional manufacturing steps are added.

Specifically, the present invention provides an appliance console assembly having a console panel presenting a face to the user of the appliance and having a cutout consisting of a shaft aperture and a rotational limit cutout. A control, having a shaft rotatable to provide a predetermined number of electrically detectable rotational control positions, supports a stop rotationally interfering with the rotational limit cutout when the control is mounted on the console with the shaft passing through the shaft aperture. The interference between the stop and the rotational limit cutout limits the rotation of the shaft to less than all the rotational control positions.

Thus it is one object of at least one embodiment of the invention to provide a selector switch that may change its number of selector positions depending on the console into which it is assembled.

The stop may be a tooth formed on the shaft, the tooth extending radially therefrom. Alternatively, the stop may be on a tooth formed on a knob affixable to the shaft with the tooth extending axially from a rear side of the knob.

It is thus another object of at least one embodiment of the invention to provide simple and flexible methods of using a cutout in the console to program the range of the switch.

The rotational limit cutout may be substantially a circular sector.

Thus it is another object of at least one embodiment of the invention to provide a simple cutout shape that may be easily fabricated.

The console may be a metal sheet providing a portion of a housing for the appliance.

It is thus another object of at least one embodiment of the invention to provide a switch that is well suited to standard appliances such as washing machines and dryers in which the cutout can be incorporated into a pre-existing part.

The console panel may have multiple cutouts and controls inserted into the cutouts and may have different rotational ranges.

Thus it is an object of at least one embodiment of the invention to allow a single switch to be used in multiple locations on an appliance with different functions.

Alternatively, the invention may allow multiple appliances having different numbers of switch-selectable features to be manufactured by providing on each appliance different rotational limit cutouts sized according to different numbers of switch-selectable features for each appliance. A standard control affixed at each cutout can thus provide different numbers of rotational control positions as determined by the console to which it is attached.

Thus it is another object of at least one embodiment of the invention to reduce the parts required to provide for a range of model types.

These particular objects and advantages may apply to only some embodiments falling within the claims and thus do not define the scope of the invention.

DETAILED DESCRIPTION OF THE PREFERRED EMBODIMENT

Figure 1:
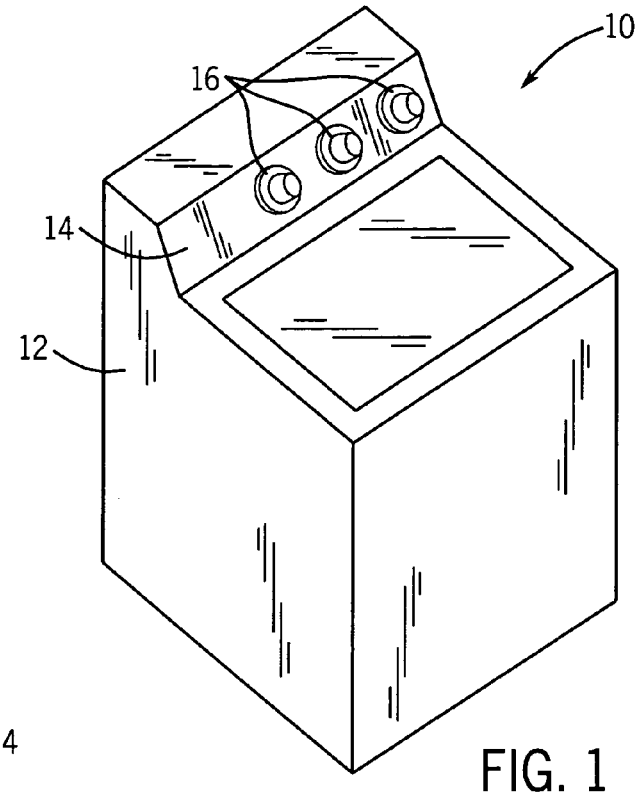
FIG. 1 is a simplified perspective view of a top-loading washing machine such as may represent a number of different models and/or which may have a number of different selector switches using the present invention.

Referring now to FIG. 1, an appliance 10 such as a top-loading washing machine may provide for a housing 12 including a console 14, the latter providing a control surface facing the user and having a number of selector controls 16 used to select operating modes of the appliance 10. The housing 12 and console 14 may be, for example, constructed of coated steel or the like.

Figure 2:
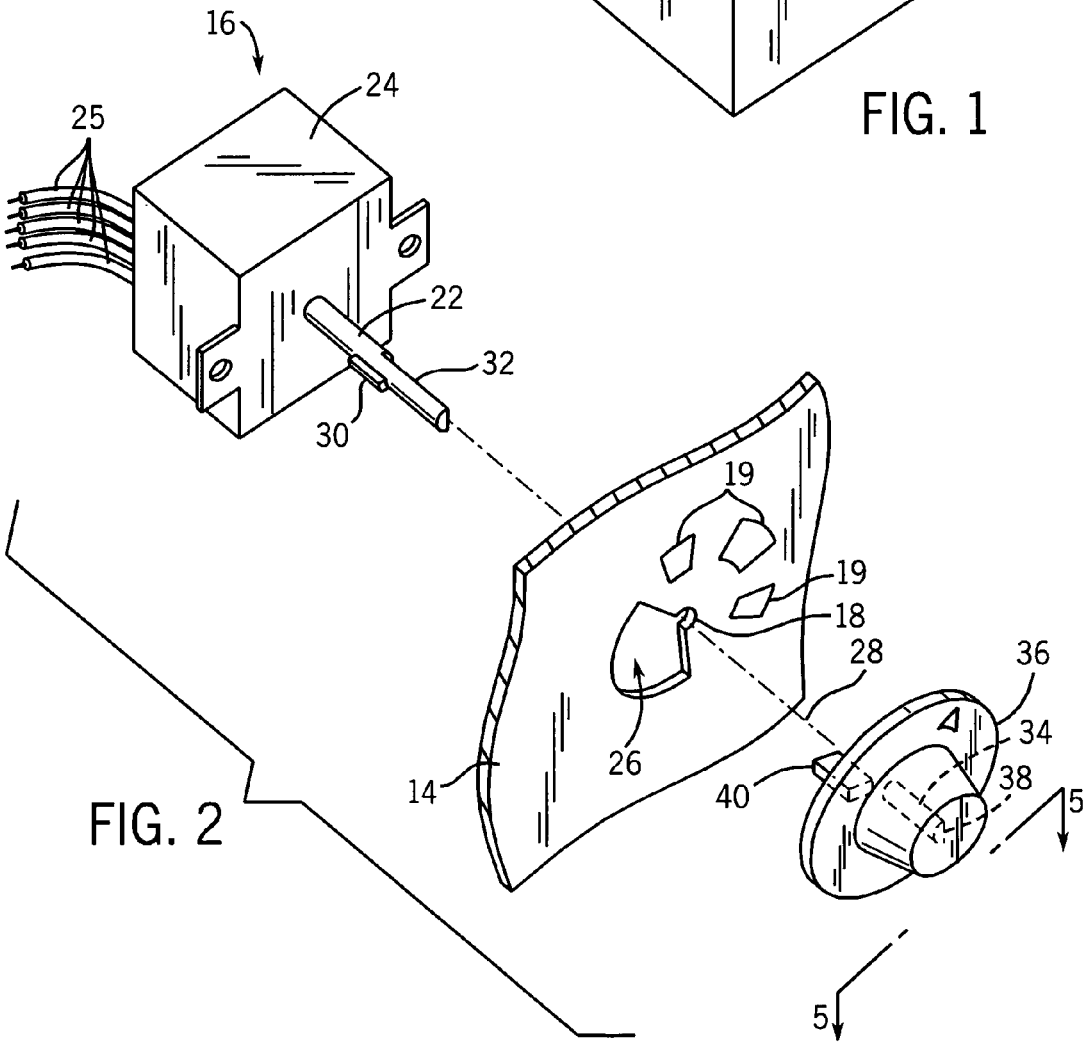
FIG. 2 is an exploded perspective view of a switch console assembly of the present invention showing a shaft aperture and rotational limit cutout in the console and showing two alternative stops, one attached to a shaft of the control and the other attached to the rear of a knob affixed to the shaft, both for limiting rotational range of the control.

Referring to FIG. 2, a shaft aperture 18 may be cut in the console 14 to permit the shaft 22 of a selector control 16 to pass from the rear side of the console 14 through to a front face of the console 14 accessible by a user. A rotational limit cutout 26 surrounds a portion of the shaft aperture 18 and will typically approximate a sector of a circle centered on the shaft aperture 18, and thus will be radially asymmetric about an axis 28 of the shaft 22. As used herein, radially asymmetric means that an arbitrary line through the axis 28 will not divide the rotational limit cutout 26 into two substantially mirror image portions.

Figure 4A:
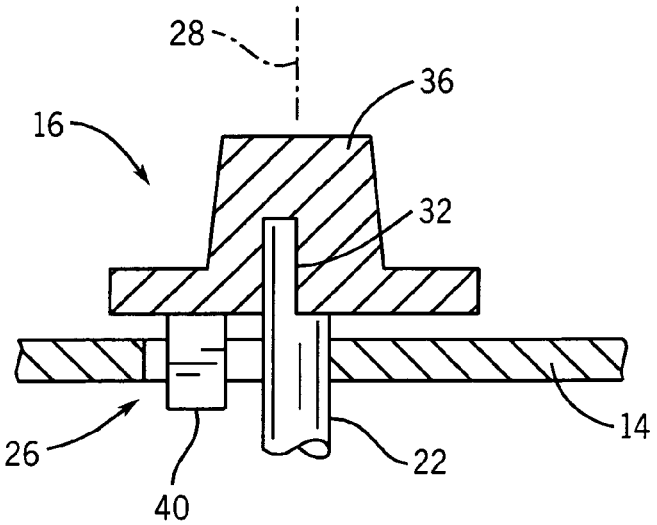
FIGS. 4*a* and 4*b* are cross-sectional views taken along line 5—5 of FIG. 2 showing the position of the stops of the knob or shaft with the rotational limit cutout.
Figure 4B:
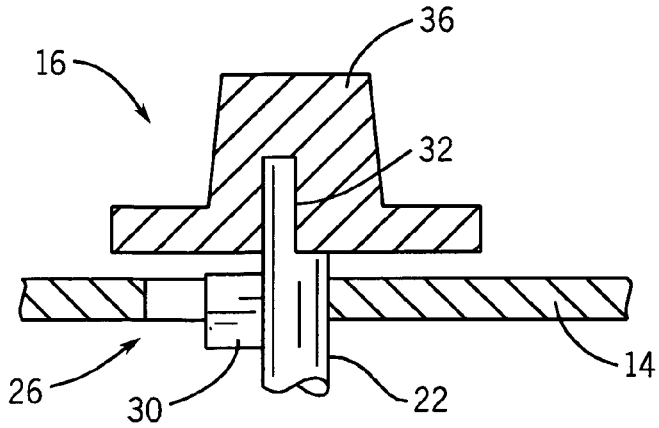

In a first embodiment shown in FIGS. 2 and 4*b*, the shaft 22 may have a radially extending tooth 30 that may fit into the rotational limit cutout 26 when a switchbox 24 of the selector control 16 is mounted at the rear of the console 14 with the shaft 22 projecting through the aperture 18. As the shaft 22 is turned, the tooth 30 swings through the rotational limit cutout 26, stopping at a clockwise and counterclockwise position by interference between the tooth 30 and the radial walls of the rotational limit cutout 26.

The shaft 22 may have a flat 32 fitting within a corresponding hole 34 with a flat 38 in a knob 36 and serving to rotationally key the shaft 22 with respect to knob 36. The knob 36 may be press fit or otherwise attached to the shaft 22 to rotate therewith.

In a second embodiment shown in FIGS. 2 and 4*a*, the knob 36 may have an axial tooth 40 extending rearwardly from the rear side of the knob 36 into the rotational limit cutout 26 to operate in a manner similar to that of tooth 30.

Figure 3:
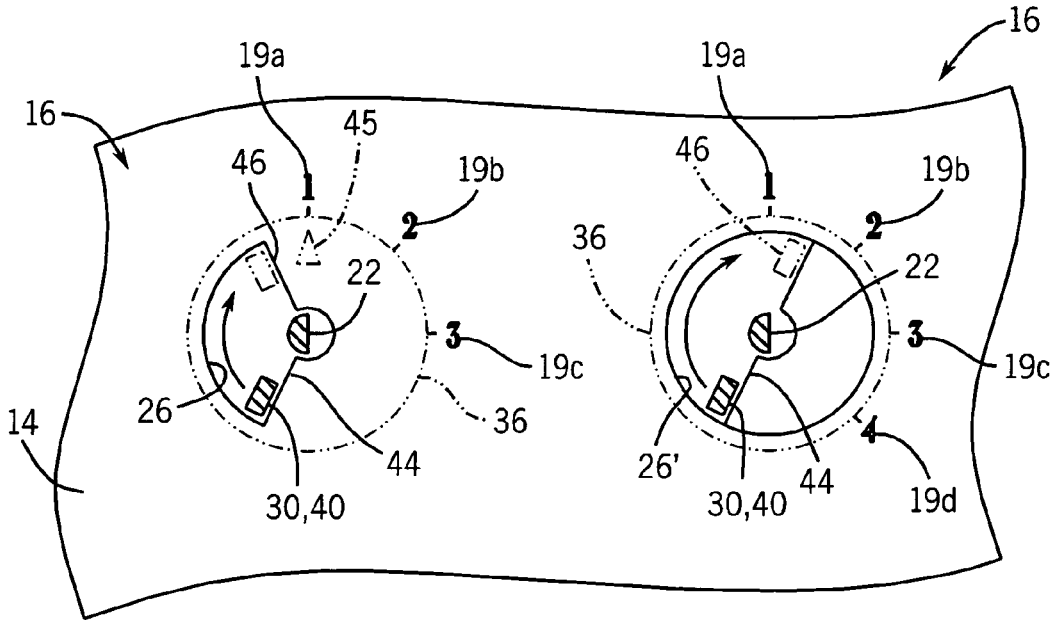
FIG. 3 is a front elevational view of the console of FIG. 1 showing two rotational limit cutouts on the same or different machines for programming a standard selector switch for three or four positions, respectively.

Referring to FIGS. 2 and 3, the front face of the console 14 may have indicia 19 corresponding to particular operating modes of the appliance 10 that may be selected by the selector control 16 as it moves through a range of control positions. The switchbox 24 typically provides internal electrical contacts controlled by a rotational position of the shaft 22 to different control positions, the contacts providing electrical signals over wires 25 indicating the control positions according to methods well known in the art. The switchbox 24 may provide detent positions at each control position. The present invention contemplates the use of a switchbox 24 having a standard number of control positions greater or equal to the largest number of control positions required of similar selector controls on an individual appliance 10 or on different models of an appliance 10.

Referring now to FIG. 3, in one embodiment, an extreme counterclockwise rotation of the knob 36, the tooth 30 or 40 will abut a radial wall 44 of the rotational limit cutout 26, providing a stop preventing further rotation of the shaft 22 in a counterclockwise direction. At this time an indicator 45 on the knob 36 may point to a first indicia 19*a*. Alternatively or in addition, this stop may be provided by a stop mechanism internal to the switchbox 24.

Clockwise rotation of the shaft 22 through at least a subset of the control positions may then be accomplished with the tooth 30 or 40 passing through the sector of the rotational limit cutout 26 to align with indicia 19*b* at a detent and corresponding control position. Further clockwise rotation can be performed until the tooth 30 or 40 (shown by dotted lines) abuts radial wall 46 of the rotational limit cutout 26 and is stopped thereby. At this time an indicator 45 on the knob 36 may point to a third indicia 19*c*.

The same selector control 16, when used with a second rotational limit cutout 26', may allow for further clockwise rotation to additional indicia 19*d* and thus a rotation of the shaft 22 through a greater angular extent of the rotational limit cutout 26'. In this way, the same selector control 16 may provide for two ranges of selection on a single machine or two ranges of selection on different models of the same machine.

It is specifically intended that the present invention not be limited to the embodiments and illustrations contained herein, but include modified forms of those embodiments including portions of the embodiments and combinations of elements of different embodiments as come within the scope of the following claims.

I claim:

1. An appliance control console comprising:

a console panel presenting a face to a user of the appliance and having a cutout including a shaft aperture and a rotational limit cutout; and a control having a shaft rotatable to provide a predetermined number of electrically detectable rotational control positions supporting a stop rotationally interfering with the rotational limit cutout when the control is mounted on the console with the shaft passing through the shaft aperture;

whereby rotation of the shaft of the control is limited to less than all the rotational control positions.

2. The appliance control of claim 1 wherein the stop is a tooth formed on the shaft extending radially therefrom.

3. The appliance control of claim 1 wherein the stop is a tooth formed on a knob affixable to the shaft of the tooth extending axially from a rear side of the knob.

4. The appliance control of claim 1 wherein the rotational limit cut out is substantially a circular sector.

5. The appliance control of claim 1 wherein the console is a metal sheet providing a portion of a housing for the appliance.

6. The appliance control of claim 1 wherein the console further includes a second cutout including a shaft aperture and a rotational limit cutout;

further including a second identical control therein including a shaft rotatable to provide a predetermined number of electrically detectable rotation control positions supporting a stop rotationally interfering with the rotational limit cutout when the control is mounted on the console with the shaft passing through the shaft aperture; and whereby the identical control of the second cutout allows different rotational ranges than that of the first cutout.

7. The appliance console of claim 6 wherein the stop is a tooth formed in the shaft extending radially therefrom.

8. The appliance console of claim 6 wherein the stop is a tooth formed on a knob affixable to the shaft the tooth extending axially from a rear side of the knob.

9. The appliance console of claim 6 wherein the rotational limit cut out is substantially a circular sector.

10. The appliance console of claim 6 wherein the console panel is a metal sheet providing a portion of a housing for the appliance.

11. A method of manufacturing multiple appliance models having different numbers of switch-selectable features comprising the steps of:

(a) providing on each appliance model a console having a face presented to a user of the appliance;

(b) making cutouts in the console face including a shaft aperture and a rotational limit cutout, the rotational limit cutout having a rotational extent determined by the different numbers of switch selectable features for the appliance the rotational extent differing among different appliance models;

(c) affixing a standard control identical among each of the appliance models at each cutout having a shaft rotatable to provide a predetermined number of electrically detectable rotational control positions supporting a stop interfering with the rotational limit cutout when the control is mounted on the console with the shaft passing through the shaft aperture;

whereby a standard control can provide different numbers of rotational control positions as determined by the console to which it is attached.

12. The method of manufacture of claim 11 wherein the stop is a tooth formed on the shaft extending radially therefrom.

13. The method of manufacture of claim 11 wherein the stop is a tooth formed on a knob affixable to the shaft of the tooth extending axially from a rear side of the knob.

14. The method of manufacture of claim 11 wherein the rotational limit cut out is substantially a circular sector.

15. The method of manufacture of claim 11 wherein the console is a metal sheet providing a portion of a housing for the appliance.

16. The method of manufacture of claim 11 wherein the standard control provides a predetermined number of electrically detectable rotational control positions over an angular range greater than that provided by the rotational limit cutout.

* * * * *